United States Patent [19]

Yoshihara

[11] Patent Number: 4,931,841

[45] Date of Patent: Jun. 5, 1990

[54] ELECTROPHOTOGRAPHIC APPARATUS HAVING ABRADED SURFACE PHOTOSENSITIVE MEMBER

[75] Inventor: Toshiyuki Yoshihara, Mitaka, Japan

[73] Assignee: Canon Kabushiki Kaisha, Tokyo, Japan

[21] Appl. No.: 137,104

[22] Filed: Dec. 23, 1987

[30] Foreign Application Priority Data

Dec. 27, 1986 [JP] Japan ..... 61-309219

[51] Int. Cl.[5] ..... G03G 15/00; G03G 5/00

[52] U.S. Cl. ..... 355/299; 355/211; 430/58

[58] Field of Search ..... 355/3 R, 15, 211, 296, 355/297, 299; 118/652; 430/58, 110, 125, 903

[56] References Cited

U.S. PATENT DOCUMENTS

| | | | |
|---|---|---|---|
| 3,910,697 | 10/1975 | Lanker | 355/15 X |
| 4,279,500 | 7/1981 | Kondo et al. | 355/15 |
| 4,379,820 | 4/1983 | Nakamura et al. | 430/58 |
| 4,543,312 | 9/1985 | Murakawa et al. | 430/903 X |

FOREIGN PATENT DOCUMENTS

| | | | |
|---|---|---|---|
| 0198363 | 10/1986 | European Pat. Off. . | |
| 61-239279 | 10/1986 | Japan | 355/15 |
| 1397754 | 6/1975 | United Kingdom . | |
| 2167199 | 5/1986 | United Kingdom . | |

*Primary Examiner*—Joan H. Pendegrass

*Attorney, Agent, or Firm*—Fitzpatrick, Cella, Harper & Scinto

[57] ABSTRACT

An electrophotographic apparatus comprises an electrophotographic photosensitive member and means for applying an electrophotographic cycle to the photosensitive member. The electrophotographic cycle includes charging, image exposure, toner development, toner transfer, remaining toner cleaning, and exposure for erasing remaining electric charge. The electrophotographic cycle application means includes abrasion means. By setting the abrasion function of the abrasion means to provide an abrasion of the surface layer of the photosensitive member at a rate of 250 Åor more per 1000 electrophotographic cycles applied to the photosensitive member, the deterioration of image quality such as image-flow and fading of images caused by succession of electrophotographic cycles is effectively prevented particularly with respect to a photosensitive member with a small diameter.

12 Claims, 3 Drawing Sheets

ELECTROPHOTOGRAPHIC APPARATUS HAVING ABRADED SURFACE PHOTOSENSITIVE MEMBER

FIELD OF THE INVENTION AND RELATED ART

The present invention relates to an electrophotographic apparatus, more particularly to an electrophotographic apparatus free from image quality deterioration during repetitive and successive operations.

As electrophotographic apparatus using an electrophotographic photosensitive member repeatedly, there are known and used laser beam printers, LED printers, liquid crystal printers, etc., in addition to ordinary electrophotographic printers.

In such an electrophotographic apparatus, around a electrophotographic photosensitive member are disposed a charger, an image exposure unit (including means for generating light spots carrying image information, such as a laser beam generator, a liquid crystal shutter array, and an LED array), developing means, cleaning means, charge-removing exposure means, etc., according to a desired electrophotographic process.

In a representative process, a photosensitive member is first positively or negatively charged by a charger and subjected to imagewise exposure to form an electrostatic latent image thereon, which is then moved to a developing station and developed with a toner. The resultant toner image is transferred onto a transfer paper, the remaining toner on the photosensitive member is removed at a cleaning station, and the remaining charge on the photosensitive member is erased by exposure. As a result of repetition of such a process, the following problems leading to image quality deterioration have occurred.

A first problem is occurrence of a so-called "image flow" which is a phenomenon that the resultant image becomes unclear like a flow of image due to attachment of low-resistivity substance on the surface of the photosensitive member caused, for example by interaction among paper dust generated from transfer paper under a high humidity condition, ozone generated due to corona discharge, nitrogen oxide generated by the ozone, etc.

Another problem is occurrence of a so-called "image-fading" which is a phenomenon that the resultant image is faded or blurred because a superficial layer of a charge transport material constituting the photosensitive member is lowered in resistivity due to reversible deterioration of the charge transport material.

These two problems lead to a remarkable deterioration of image quality, so that various countermeasures have been taken.

For example, in order to cope with the former image-flow problem, there have been tried or proposed to minimize the occurrence of paper dust in the paper supply system for transfer papers, to demoisten the neighborhood of the photosensitive member surface, to provide a device for forcibly removing low-resistivity attachments and to effect development by causing a developer layer containing a magnetic toner to contact the photosensitive member as disclosed in Japanese Laid-Open Patent Application No. 188,960/1985. On the other hand, in order to cope with the fading problem, various proposals have been tried to dispose a device for forcibly evacuating generated ozone as disclosed in Japanese Laid-Open Patent Application No. 63630/1976, and to search for a material resistant to deterioration. The above countermeasures respectively involve a problem such as an increase in cost, enlargement of an apparatus size, and a cause of further unforeseen difficulties. Further, it is a present status that the above-mentioned image-flow and fading problems have not been fully solved even if the above countermeasures are applied.

SUMMARY OF THE INVENTION

An object of the present invention is to provide a electrophotographic apparatus free from the above-mentioned difficulties, i.e., image quality deterioration, such as image-flow or fading.

A specific object of the present invention is to provide a compact and inexpensive electrophotographic apparatus free from the above difficulties.

As a result of my study on the above problems, it has been found that the image quality deterioration described above can be obviated by an electrophotographic apparatus comprising an electrophotographic photosensitive member which has a surface with an appropriate abrasion characteristic so that lowresistivity attachments and deteriorated charge transport material are always removed by an ordinary cleaning step.

More specifically, according to the present invention, there is provided an electrophotographic apparatus comprising an electrophotographic photosensitive member and means for applying an electrophotographic cycle to the electrophotographic photosensitive member, wherein said means for applying an electrophotographic cycle includes abrasion means, and the abrasion means causes an abrasion of the surface layer of the photosensitive member at a rate of 250 Å or more per 1000 electrophotographic cycles applied to the photosensitive member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

In FIGS. 2A –2C and 3, $V_D$ denotes a dark part potential, $V_H$ a medium tone potential, and $V_L$ a light part potential.

DETAILED DESCRIPTION OF THE INVENTION

Figure 1:
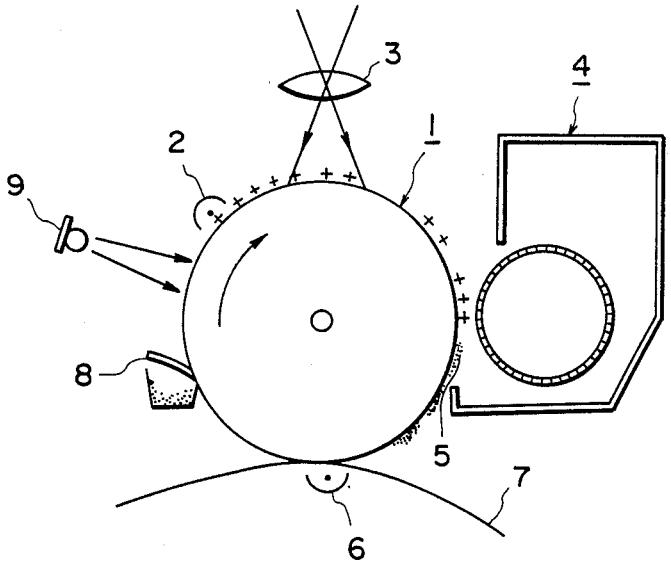
FIG. 1 is a schematic view of an essential part of an embodiment of the electrophotographic apparatus of the present invention.

FIG. 1 is a schematic partial view showing an essential part of an embodiment of the electrophotographic apparatus according to the present invention.

Referring to FIG. 1, the electrophotographic apparatus comprises a photosensitive member 1 and around the photosensitive member 1, a charger 2, an image exposure system 3 for forming an electrostatic latent image, a developing apparatus 4 for developing the latent image with a toner 5 to form a toner image, a transfer charger 6 for transferring the toner image from the photosensitive member 1 onto a transfer paper 7, a cleaning unit 8, and an exposure system 9 for erasing remaining charges on the photosensitive member 1.

In operation, the photosensitive member is first uniformly charged by the charger 2 and then exposed to an original light image through the image exposure system 3 to form a latent image on the photosensitive member 1. Then, a toner 5 from the developing apparatus 5 is attached to the latent image on the photosensitive member 1 to form a toner image. The toner image on the photosensitive member 1 is then transferred to a transfer paper 7 by means of the transfer charger 6. The remaining toner on the photosensitive member 1 is then removed by the cleaning unit 8, and the remaining charge on the photosensitive member is erased by exposure from the exposure system 9.

In the present invention, instead of taking countermeasures against the factors causing image quality deterioration involved in the repeating steps or cycle of electrophotography as described above, it is intended to always scrape out the products causing the deterioration from the surface of the photosensitive member 1, thereby cleaning the surface and stabilizing the image quality.

More specifically, paper dust attachments and ozone degradation products in the neighborhood of the photosensitive member surface are removed by scraping the surface layer of the photosensitive member at a specified rate by abrasion or wearing means to prevent the lowering in resistivity of the photosensitive member surface, whereby clear latent images can be stably formed.

In an electrophotographic apparatus, such an abrasion characteristic or scrapability of a photosensitive member is determined through combination of several factors, such as the abrasion characteristic of the photosensitive member per se, set cleaning conditions, and properties of a developer such as a toner. Accordingly, in numerically defining the abrasion characteristic of the surface layer, it is considered proper to define the change in thickness of the photosensitive member for a specified number of rotations of the photosensitive member or electrophotographic cycles applied to the photosensitive member. However, the relation between the number of rotations and the number of copies can vary depending on various factors, such as the shape of the photosensitive member, i.e., a cylinder and its diameter, a seamless endless belt and its length and an endless belt having a seam and its effective length, and other apparatus and process conditions, such as a process speed, a pre-rotation period and post-rotation period.

Based on the above knowledge, I have studied surface cleaning conditions for effectively preventing image quality deterioration. As a result, I have found it proper that the surface layer of the photosensitive member is abraded or scraped off at a rate of 250 Å or more for each 1000 electrophotographic cycles applied to the photosensitive member.(Herein, only normal electrophotographic cycles are considered as a basis, and pre-rotation and post-rotation are excluded. In the case of a multi-color electrophotographic process, each color formation step basically involves a unit electrophotographic cycle.) If the abrasion loss per 1000 rotations (i.e., 1000 electrophotographic cycles) is less than 250 Å, low-resistivity attachments are not sufficiently removed from the surface layer but are gradually accumulated and the layer of ozone-degraded products in the neighborhood of the surface gradually increases its thickness, so that the image quality degradation along with increase in number of copying cannot be obviated.

Even in the region of 250 Å or more, the abrasion loss per 1000 rotations is preferably 500 Å or more, further preferably 800 Å or more, for the effectiveness of the present invention. This is because a larger abrasion rate allows a larger proper latitude for factors not relating to the surface abrasion but relating to the image quality deterioration in an electrophotographic apparatus, such as an ozone concentration in the apparatus, quantity of paper dust generated in the paper supply system, and humidity and temperature around the photosensitive member and allows easier designing of the apparatus.

Further, in an electrophotographic apparatus such as a laser beam printer for example wherein an electrostatic latent image is formed at a high resolution by laser beam spots, image quality deterioration such as image flow or fading is much more liable to occur than in an ordinary copying machine. Accordingly, in such an electrophotographic apparatus, a larger abrasion rate is required, preferably 800 Å or more, further preferably 1500 Å or more, per 1000 rotations of the photosensitive member. This also holds true with an ordinary type of copying machine requiring a still higher resolution. Herein, the abrasion rate of the surface layer of a photosensitive member is based on values measured by using an eddy current-type film thickness meter available from KETT Co.

On the other hand, apart from difficulties such as image-flow and fading caused by decreases in clearness and resolution of electrostatic latent images, there are also observed other phenomena such as ground fog, black streaks or black spots because of attachment of a toner or additive to the toner onto the surface to hinder imagewise exposure. These phenomena are concerned with many factors such as a toner material composition, development conditions, input image density, transfer conditions, cleaning conditions, material composition of the surface layer, etc. It has been found that the abrasive characteristic also has an effect of suppressing these phenomena. This is considered because the attached toner or additive is removed along with the abrasion of the surface layer similarly as in prevention of image-flow and image-fading.

Further, an electrophotographic photosensitive member comprising an organic photoconductor generally has a tendency to be degraded and cause an increase in remaining potential when exposed to strong irradiation of natural light. More particularly, this difficulty is caused by irradiation of a charge transport material in the neighborhood of the surface due to irradiation of ultraviolet rays. Accordingly, if the photosensitive member is exposed to external light in order to deal with plugged paper, to replenish a toner, to clean the charger, etc., images at the corresponding parts are liable to cause fogging. Also in this case, in an electrophotographic apparatus wherein the surface layer of the photosensitive member is abraded to some extent, the parts degraded by ultraviolet ray exposure are scraped off along with successive copying to suppress occurrence of image fog.

The present invention is particularly significant for a small-sized electrophotographic apparatus using a cylindrical photosensitive member (drum) having a drum diameter of 60 mm or less, particularly 30 mm or less.

More specifically, where a small-diameter cylindrical photosensitive member having a drum diameter of 60 mm or less, particularly 30 mm or less, is used for copying, an increased number of rotations is required for a unit number of copies compared with a case where a large-diameter photosensitive member is used. As a result, a unit area of the photosensitive member surface is more frequency exposed to ozone, nitrogen oxides, etc., so that a drum of a smaller diameter causes an increased degradation. Under such severe electrophotographic conditions, satisfactory results have not been attained by conventional countermeasures to image-flow and fading.

When applied to such a small-sized electrophotographic apparatus, the present invention provides excellent qualities of images having solved image qualities deteriorations, such as image-flow and fading.

Factors controlling the abrasion rate of the surface layer of the photosensitive member may include: (1) abrasion characteristic of the surface layer per se, (2) cleaning conditions affecting the abrasion, (3) development conditions affecting the abrasion, (4) material and composition of a developer such as a toner affecting the abrasion. The respective factors will be more specifically explained.

(1) The surface layer of a photosensitive member is composed of a protective layer or a photosensitive layer if the protective layer is not present. If the protective layer comprises mainly a film-forming resin or if the surface photosensitive layer comprises an organic photoconductive material of a relatively low molecular weight and a film-forming binder resin. The abrasion characteristic of the film-forming resin constitute a major factor determining the rate of abrasion of the surface layer. In addition, the abrasion rate can also be controlled by the content of the low-molecular weight organic photoconductive material, addition of a low-molecular weight compound which is electrophotographically inert, etc.

(2) The cleaning of the photosensitive member may generally be conducted by blade cleaning, magnetic brush cleaning, fur brush cleaning, etc., especially in a small-sized electrophotographic apparatus. Particularly, in the blade cleaning system, the abrasion rate of photosensitive member surface layer may be controlled by controlling factors such as a blade material, a contact angle against the surface, a linear pressure, a free length, etc. In other cleaning systems, the abrasion rate may be controlled by changing a load against the surface layer.

(3) In the development step, the factors affecting the abrasion rate of the surface layer may include: an abrasive material or magnetic material in a developer, for example, in a one-component developer system, and carrier shape, carrier size, height of toner-brush at the time of development in a two-component developer system.

(4) In the above-mentioned cleaning step and the development step using a certain developer system, the abrasion of the surface layer is promoted by the co-presence of a toner. Accordingly, the abrasion rate can be controlled by selection of a toner material, additive and a carrier.

In the one-component system toner containing a magnetic material, an abrasive material is generally added. As a result, the abrasion rate of the surface layer can be controlled changing the kind and the rate of addition of the abrasive material. Examples of the abrasive material may include cerium oxide, alumina, silica, and strontium titanate. It is generally preferred that the addition rate is 0.05 -2%. If the surface layer is liable to be scratched excessively by the addition of the additive, it is possible to co-use a lubricating material to suppress the occurrence of scratches. Examples of the material for this purposes may include metallic salts or esters of long-chain aliphatic acids, and fluorine-containing vinyl polymers. The addition rate may generally be preferably 0.01 -2%. These additives are generally added to toner particles in the form of external addition, but the toner particles can further contain polyolefin inside the particles. The polyolefin is added principally for preventing offset at the fixing stage. However, the abrasion rate of the surface layer can be controlled by changing the kind and the quantity of the polyolefin.

In the present invention, it is preferred that the abrasion means comprises a developer, preferably a one-component system developer containing a magnetic material, particularly one combined with an abrasive material in order to control the abrasion rate of the photosensitive member to obtain excellent effects.

Further, in order to control the abrasion rate of the photosensitive member to obtain excellent effects in the present invention, it is preferred that the abrasion means comprises a cleaning blade. The use of a cleaning blade is particularly advantageous in control of the abrasion rate because the entire surface of the photosensitive member can be cleaned as well as abraded at a small stress without causing local concentration of stress. It is further preferred that the cleaning blade comprises urethane rubber having a hardness of 60°-80° (as measured according to JIS-K603) by using a JIS A-type hardness meter) and exerts a linear pressure of 20 g/cm -40 g/cm, particularly 25 g/cm -35 g/cm, against the surface layer of the photosensitive member. It is also preferred that the cleaning blade contacts the photosensitive member at a contact angle ($\theta$) of 20°-30° in a counter direction with respect to the rotation of the photosensitive member.

The electrophotographic photosensitive member used in the present invention may comprise a photosensitive layer on an electroconductive support. The present invention may preferably have a laminated structure including a charge generation layer and a charge transport layer. The charge generation layer is a layer wherein charge carriers are generated by incident light corresponding to image information and the generated carriers are injected into the charge transport layer without causing recombination or trapping of the carriers. In order to shorten the travelling path of the charge carrier, the charge generation layer is preferably in the form of a thin film having a thickness of 5 $\mu$m or less, particularly 0.01-1 $\mu$m. The charge generation layer may be formed by dispersing or dissolving a charge generation material such as azo pigment, phthalocyanine pigment, anthoanthrone pigment or dibenzpyrene in an appropriate binder resin to provide a coating composition, and forming a layer of the coating composition on the support by coating or vapor-deposition by means of a vacuum vapor-deposition apparatus.

The charge transport layer is disposed in electrical contact with the charge generation layer and has functions of receiving charge carriers injected from the charge generation layer in the presence of an electric field and transporting carriers therethrough.

The charge transport layer may be formed by dissolving or dispersing a charge-transporting material, such as hydrazone, pyrazoline, oxazole, thiazole or oxathiazole, in a film-forming binder resin to form a coating liquid, followed by application and drying.

The charge transport layer may be formed above or below the charge generation layer to form a laminated photosensitive layer.

Where the charge transport layer constitutes the surface layer, it is preferred that the charge transport layer has a thickness of 5–50 μm, particularly 10–35 μm in view of abrasion durability and surface potential stability. Also where the charge generation layer constitutes the surface layer, it is preferred that the charge generation layer has a thickness of 5–12 μm in view of abrasion durability and surface potential stability. For this purpose, it is preferred that the charge generation layer contains also a charge-transporting material so as to promote the transportation of charge carriers through the charge generation layer.

In any layer structure, it is preferred in the present invention that the surface comprises at least a charge-transporting material and a binder resin.

The binder resin may for example be acrylic resin, polystyrene, polycarbonate resin or may comprise a copolymer of monomers constituting these polymers or a mixture of these polymers.

The electroconductive support may for example comprise an aluminum cylinder, an aluminum sheet, or an aluminum cylinder, aluminum sheet or plastic cylinder coated with vapor-deposited metal film or an electroconductive film applied thereto.

It is possible to provide an intermediate layer between the electroconductive support and the photosensitive layer for the purpose of, e.g., improved adhesion or charge-injection characteristic.

The surface layer of the photosensitive member used in the present invention may preferably have a hardness of 60 g or less, particularly 20–50 g. If the hardness exceeds 60 g, the electrophotographic process must be conducted under severer conditions, such as the use of increased amount of an abrasive material in the toner or a toner having a higher hardness. These conditions rather provide a fatal scratch or damage to the photosensitive member surface because of the toner, cleaning blade or attached foreign matter or cause partial peeling of the surface layer to result in image defects. Further, a toner containing a large amount of abrasive rather deteriorates developing characteristics.

On the other hand, if the surface layer of the photosensitive member satisfies the above mentioned hardness, high-quality images free of image defects can be stably obtained.

Herein, the surface hardness of a photosensitive member is measured as follows. A diamond stylus of 0.5 mm-diameter is placed on the surface of a photosensitive member and the photosensitive member is rotated in the peripheral direction while placing various loads on the diamond stylus. The value of the load (g) giving a scratch of 5 μm in depth is defined as the surface hardness of the photosensitive member.

In adjusting the hardness of the surface layer, it is preferred that the surface layer contains a binder resin in a proportion of 70 wt. % or less while it somewhat depends of the kind of the binder resin.

Through adjustment of the above factors, the electrophotographic apparatus is designed so as to provide an abrasion rate of the surface layer of the photosensitive member of 250 Å or more for each 1000 electrophotographic cycles. In this instance, however, it is not desirable if the latent image potential on the photosensitive member remarkably changes as the surface layer decreases its thickness in this way.

In the present invention, with respect to latent image surface potential on the photosensitive member, either the dark potential or medium tone potential is set to change by not more than 15 V per μm of decrease in thickness of the surface layer.

This is explained in more detail hereinbelow with reference to a case of a electrophotographic photosensitive member having a laminated photosensitive layer comprising a charge transport layer on a charge generation layer.

In this form of photosensitive member, the charge transport layer corresponds to the surface layer, and the thickness of the charge transport layer constitutes the greatest factor determining the chargeability. Accordingly, as the thickness decreases, the dark part potential is lowered. On the other hand, the thickness of the charge generation layer responsible for generation of charge carriers is not changed so that there is little change in amount of generated carriers. As a result, the light part potential depends little on the thickness of the charge transport layer. In the meantime, the decrease in chargeability due to the decrease in thickness of the charge transport layer can be moderated or flattened to some extent by varying the charging conditions. In the case of corona charging, this may be accomplished by changing the shape of the charger, the height of discharge wire in the charger above the photosensitive member surface, introduction of a grid bias, etc. When the chargeability is flattened in this way, there result in a decrease in contrast and an increase in light part potential as the thickness is decreased. This relationship is illustrated in FIGS. 2A–2C.

Figure 2A:
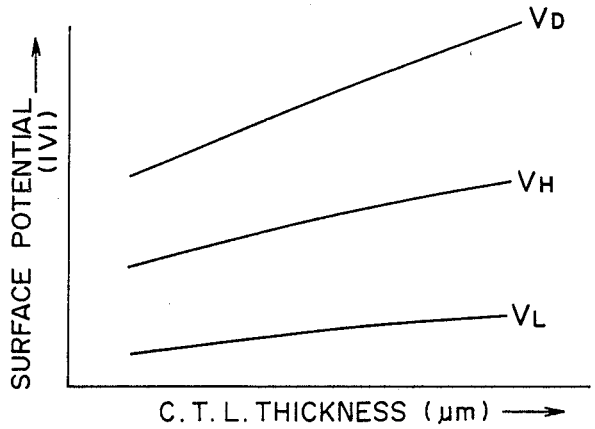
FIGS. 2A to 2C are graphs each showing the dependency of the surface potential of a photosensitive member comprising a charge transport layer (C.T.L.) on a charge generation layer (C.G.L.) on the thickness of the charge transport layer.
Figure 2B:
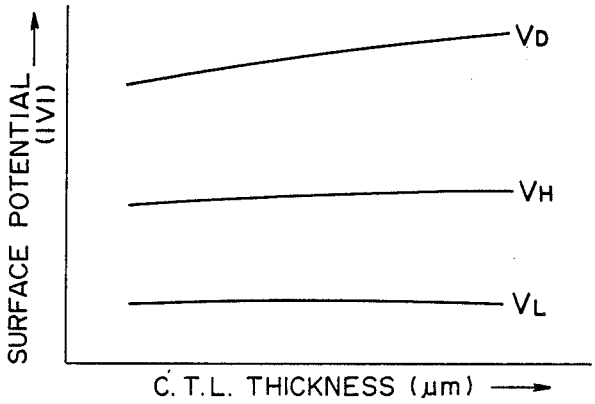
Figure 2C:
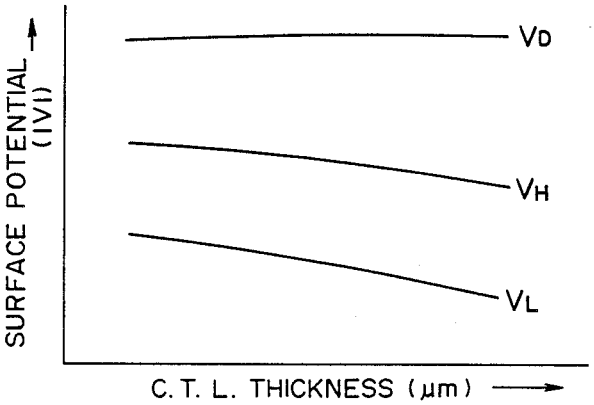

FIGS. 2A–2C all show the dependency of surface potentials ($V_D$: dark part potential, $V_H$: medium tone potential, $V_L$: light part potential) on the thickness of the charge transport layer. More specifically, $V_D$, $V_H$ and $V_L$ are surface potentials where photosensitive layers are exposed to reflected light rays from originals having reflection densities of 1.3±0.05, 0.3±0.02, and 0.07±0.2, respectively. FIG. 2A shows a dependency of the chargeability of a photosensitive member on the thickness of the charge transport layer. FIG. 2C shows a system wherein the chargeability characteristic is flattened. FIG. 2B shows a system showing a medium chargeability characteristics between the systems shown in FIGS. 2A and 2C.

Incidentally, electrophotographic apparatus include a type wherein image data are supplied in a positive form as in an ordinary copying machine and a type wherein image data are supplied in a negative form as in a laser beam printer. Correspondingly, a normal development system is adopted, in the former type of apparatus, and a reversal development system is used in the latter type of apparatus. Accordingly, when the surface potential change accompanying the decrease in thickness of the charge transport layer is controlled, the level of potential or parts of images to be controlled may be different. For example, in an ordinary copying machine using a normal development system, a system wherein a medium tone potential which changes frequently corresponding to image density change is flattened (as in FIG. 2B) is preferred. On the other hand, in a laser beam printer performing image scanning, a system where a dark part potential is flattened (FIG. 2C) is preferred in order to prevent ground fog, and a system where a light part potential is more flattened (FIG. 2B) is preferred from a viewpoint of putting more weight on the image density. Herein, the difference in each level of potential depending on the change in thickness of the surface layer is set to 15 V/μm or less, more preferably 10 V/μm or less.

It is preferred that the charge transport layer has an initial thickness of generally 5–50 μm, particularly 10–35 μm. A thickness exceeding 50 μm results in difficulties, such as a difficulty in formation of a uniform film, formation of cracks in the film and increase in remaining potential. On the other hand, an initial thickness less than 10 μm leads to a difficulty that pin holes are liable to be formed by charging due to the decrease in film thickness of the photosensitive member during successive electrophotographic operations even if the stability in surface potential is retained.

The optimum film thickness may be determined for each electrophotographic apparatus as the allowable film thickness change during the life of a photosensitive member varies depending the required life of the photosensitive member and a number of electrophotographic cycles required of the photosensitive member for one output.

Herein, specific embodiments of the present invention will be described by way of examples.

Example 1

There was provided an electrophotographic apparatus for practicing an electrophotographic process including negative corona charging, positive image exposure with visible light rays, normal development with a one-component positive magnetic toner, transfer with a negative corona charge, plate blade cleaning, and pre-exposure irradiation. The toner composition and cleaning conditions affecting the abrasion of the surface layer of the photosensitive member were as follows.

[Toner composition]

(1) magnetic material: $\gamma$-$Fe_2O_3$/$Fe_3O_4$,
(2) binder: styrene-acrylic resin/styrene-butadiene resin
(3) polyethylene: added in a proportion of 1.5% of (1)+(2)
(4) externally added abrasive: strontium titanate 0.8%

[Cleaning condition]

(1) blade material: urethane rubber, hardness: 65°
(2) blade thickness: 1.5 mm
(3) linear pressure on the surface layer: 15, 25 and 35 g/cm, three levels.
(4) contact angle against the photosensitive member: $\theta=24°$ The photosensitive member for electrophotography was one prepared by coating an Al cylinder of 30 mm-dia.×260 mm-length successively with an intermediate layer, a charge generation layer and a charge transport layer in this order. The charge generation layer was composed of 2 parts (wt. parts) of a charge generating material represented by the formula:

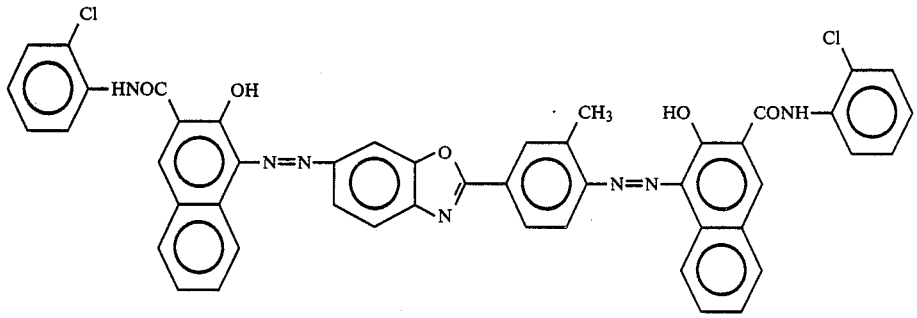

and 1 part polyvinyl butyral resin. The charge transport layer constituting the surface layer was composed of 9 parts (wt. parts) of hydrazone compound (charge-transporting material) represented by the formula:

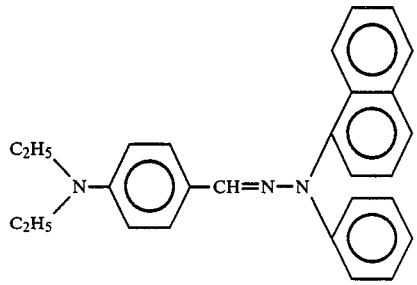

and 10 parts of styrene-acrylic copolymer (binder resin). The charge transport layer was formed in an initial thickness of 24 μm and showed a surface hardness of 35 g.

The photosensitive member was set to have a surface potential characteristic as shown in FIG. 1B dependent on the thickness of the charge transport layer by using a charger of 10 mm in width and a process speed of 50 mm/sec, and the medium tone potential showed a thickness dependency of 8 V/μm.

The electrophotographic apparatus was used for performing electrophotographic operations while changing the linear pressure of the cleaner blade at three levels, and 10,000 sheets of copying were conducted for each operation. The tests were conducted under two sets of conditions, i.e., normal temperature-normal humidity (23° C.—55%RH) and high temperature-high humidity (32° C.—90%RH). The results are summarized in Table 1 below. Incidentally, in the apparatus, 8 rotations of the photosensitive member were required for producing one A-4 sized copy. As a result, 10000 sheets of copying required 80,000 rotations in total. The abrasion rate per 1000 rotations was calculated from the change in thickness after the 10000 sheets of copying, i.e., 80,000 rotations. The evaluation standards for the respective items are as follows:

[Image-flow]

o: Not observed

Δ: Not observed in the successive copying test, but observed on several sheets of copies after standing overnight and re-starting. The image-flow disappeared thereafter.

x: Unacceptable image-flow was observed.

[Fading]

o: Not observed at all.

Δ: Slight decrease in resultion was observed, while it was practically of no problem.

x: Unacceptable fading observed.

TABLE 1

10000 sheets - successive image formation test

| Environment | Item | Blade linear pressure 15 g/cm | 25 g/cm | 35 g/cm |
|---|---|---|---|---|
| 23° C./55% RH | Image-flow | x | o | o |
| | Fading | x | o | o |
| | Abrasion/1000 rotations (Å) | 210 | 650 | 1000 |
| | Medium tone potential change* (V) | ±15 | −10 | −30 |
| | Image density change | very little | very little | very little |
| | Abration scratches on images | none | none | none |
| 32° C./90% RH | Image-flow | x | Δ | o |
| | Fading | x | o | o |
| | Abration/1000 rotations (Å) | 180 | 580 | 880 |
| | Medium tone potential change* (V) | +20 | −10 | −25 |
| | Image density change | very little | very little | very little |
| | Abration scratches on images | none | none | none |

*Medium tone potential change = (potential after the copying test) − (potential at the initial stage)

As shown in the above Table 1, deterioration of image quality could be prevented by increasing the linear pressure of the cleaning blade to provide a large abrasion rate. Under the cleaning conditions including a linear pressure of 25 g/cm, no trouble was encountered at all in the normal environment but slight image-flow occurred in the environment of high temperature-high humidity. On the other hand, at a blade pressure of 15 g/cm, attachment of the toner in the form of spots on the surface layer was observed at the time of about 8000 sheets of copying and so on. Such a difficulty in image was not encountered at all under the other two linear pressures.

On the other hand, the change in medium tone potential was smaller than the value calculated from the above-set thickness dependency of 8 V/μm and the actual reduction in thickness in any of the above cases. This is because the remaining potential was increased due to deterioration of electrophotographic characteristics through repeating use of the photosensitive member and the medium tone potential was increased correspondingly. Such deterioration of electrophotographic characteristics does not provide a practical problem at all within some extent but can rather affects advantageously against image quality change as in this example.

Example 2

An electrophotographic apparatus of the same structure as in Example 1 was used. The toner composition and the cleaning conditions used were as follows:

[Toner composition]

(1) magnetic material: $\gamma$-$Fe_2O_3/Fe_3O_4$.

(2) binder: styrene acrylic resin/styrene-butadiene resin.

(3) polypropylene: added in a proportion of 1.5% of (1)+(2).

(4) externally added abrasive: cerium oxide, added at rates of 0.1%, 0.5% and 1.2%, three levels.

[Cleaning conditions]

(1) blade material: urethane rubber, hardness: 73°.

(2) blade thickness: 1.2 mm (3) linear pressure on the surface layer: 27 g/cm (4) contact angle against the photosensitive member: $\theta=24°$ The photosensitive member used was of the same structure as the one used in Example except that the charge transport layer was composed of 10 parts of hydrazone compound (the same as used in Example 1) and 10 parts of polyphenyl methacrylate resin (binder) and formed to have an initial thickness of 27 82 m and a surface hardness of 40 g.

The results of 10,000 sheets of successive copying tests conducted in the same manner as in Example 1 are shown in the following Table 2.

TABLE 2

10000 sheets - successive image formation test

| Environment | Item | Amount of cerium oxide 0.1% | 0.5% | 1.2% |
|---|---|---|---|---|
| 23° C./55% RH | Image-flow | o | o | o |
| | Fading | o | o | o |
| | Abrasion/1000 rotations (Å) | 290 | 550 | 960 |
| | Medium tone potential change* (V) | ±25 | +10 | −15 |
| | Image density change | very little | very little | very little |
| | Abration scratches on images | none | none | none |
| 32° C./90% RH | Image-flow | Δ | Δ | o |
| | Fading | Δ | o | o |
| | Abration/1000 rotations (Å) | 280 | 520 | 990 |
| | Medium tone potential change* (V) | +30 | +10 | −10 |
| | Image density change | very little | very little | very little |
| | Abration scratches on images | none | none | none |

*Medium tone potential change = (potential after the copying test) − (potential at the initial stage)

As shown in Table 2, deterioration of image quality could be suppressed by adding different amounts of abrasive material to the toner. In this electrophotographic apparatus, however, an abrasion rate of about 500–600 Å or less per 1000 rotations caused slight degree of image-flow and fading in the environment of high temperature and high humidity. These results are substantially in line with the results in Example 1. On the other hand, an abrasion rate exceeding 800 Å gave sufficient image qualities under any environmental conditions.

Example 3

There was provided an electrophotographic apparatus adapted for practicing an electrophotographic process including negative corona charging, negative image exposure with semiconductor laser writing beam (density of 300 laser spots or dots per inch), reversal development with a two-component-type negative toner, transfer with a positive corona charge, plate blade cleaning, and pre-exposure irradiation. The toner composition and the cleaning conditions were as follows.

[Toner]

colorant: phthalocyanine pigment (blue)
binder: polyester
carrier: substantially spherical particles of acrylic resin-coated iron powder having a diameter of 40–50 μm.

[Cleaning conditions]

blade material: urethane rubber, hardness: 73°
blade thickness: 2 mm
linear pressure on the surface layer: 28 g/cm
contact angle against the photosensitive member: $\theta=24°$ Three photosensitive members were prepared by coating a cylinder of 30 mm-dia×260 mm length with an intermediate layer a charge generation layer with a sensitivity to wavelengths around 780 nm composed of 2 parts of a chage-generating material represented by the formula shown below and 1 part of polyvinyl butyral resin, and a surface layer of a charge transport layer composed of either one of three compositions comprising 8 parts of a hydrazone compound (charge-transporting material) represented by the formula below and 10 parts of polycarbonate A, polymethylmethacrylate and polystyrene, respectively, (as binder).

[Charge-generating material]

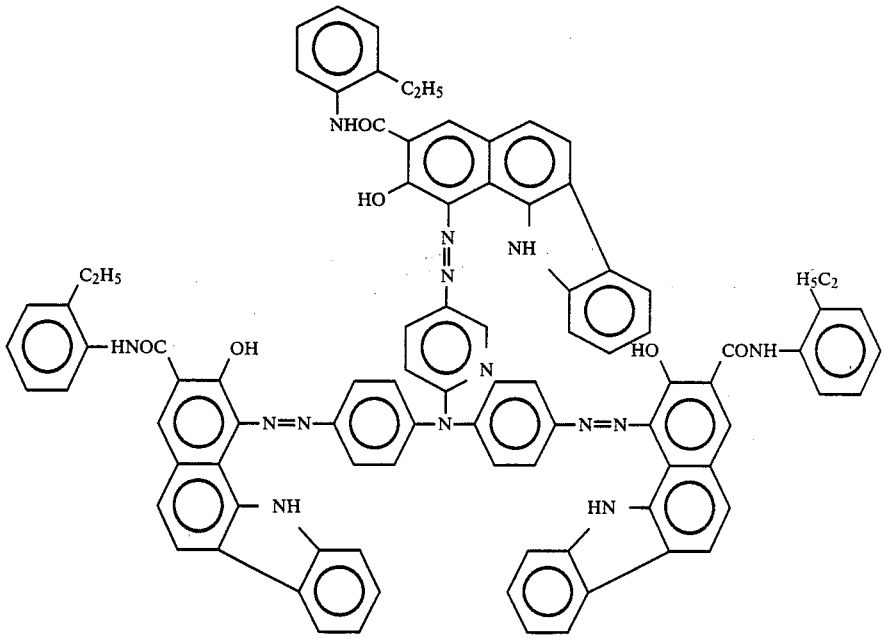

[Charge-transporting material]

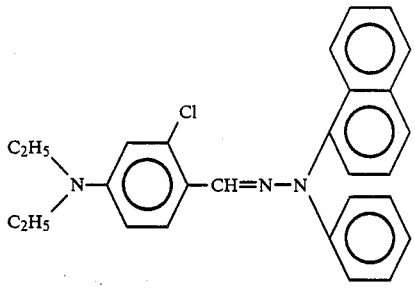

Further, one more photosensitive member was prepared in the same manner except for forming a charge transport layer with a composition comprising 8 parts of the hydrazone compound, 10 parts of the polycarbonate A and 4 parts of methaterphenyl (plasticizer).

Each charge transport layer was formed in an initial thickness of 22 μm

Successive image forming tests of 6000 sheets each were conducted by using the respective photosensitive members. The results are shown in the following Table 3.

TABLE 3

| | | 6000 sheets of successive image formation test | | | |
|---|---|---|---|---|---|
| Environment | Item | Polycarbonate A hardness 68 g | Polycarbonate A + terphenyl 55 g | Polymetyyl methacrylate 50 g | Poly-styrene 25 g |
| 23° C./55% RH | Image-flow | x | o | o | o |

TABLE 3-continued

| Environment | Item | 6000 sheets of successive image formation test: Polycarbonate A hardness 68 g | Polycarbonate A + terphenyl 55 g | Polymetyyl methacrylate 50 g | Poly-styrene 25 g |
|---|---|---|---|---|---|
| | Fading | x | Δ | o | o |
| | Abrasion/1000 rotations (Å) | 100 | 500 | 900 | 1700 |
| | Medium tone potential change* (V) | −10 | −15 | −15 | −30 |
| | Image density change (fog) | very little | very little | very little | very little |
| | Abration scratches on images | none | none | none | none |
| 32° C./90% RH | Image-flow | x | o | o | o |
| | Fading | x | Δ | Δ | o |
| | Abration/1000 rotations (Å) | 80 | 500 | 900 | 1700 |
| | Medium tone potential change* (V) | −10 | −10 | −10 | −25 |
| | Image density change (fog) | very little | very little | very little | very little |
| | Abration scratches on images | none | none | none | none |

As shown in above Table 3, deterioration of image quality could be also suppressed by changing the binder resin to provide an increased abrasion rate.

In this example, a laser beam printer using a laser spot exposure system at a density of 300 dots per inch was used. As a result, an abrasion rate of 900 Å or less per 1000 rotations as given by using polymethyl methacrylate, etc., gave slight fading of images in an environment of high temperature-high humidity while it was of no problem in an ordinary environment. On the other hand, an abrasion rate of 1500 Å or more as given by using polystyrene was free of deterioration of image quality in any environment.

In this embodiment, a reversal development system was adopted, so that ground fog due to a decrease in dark part potential was prevented by providing the charger with a grid to set the dark part potential change depending on the surface layer thickness change to 5 V/μm.

Example 4

There was provided an electrophotographic apparatus for practicing an electrophotographic process including positive corona charging, positive image exposure with visible light rays, normal development with a one-component negative magnetic toner, transfer with a positive corona charge, plate blade cleaning, and pre-exposure irradiation. The toner composition and cleaning conditions were as follows.

[Toner composition]

(1) magnetic materia: $\gamma$-$Fe_2O_3$/$Fe_3O_4$
(2) binder: styrene-acrylic resin/styrene-butadiene resin.
(3) polyethylene: added in a proportion of 1.5% of (1)+(2).
(4) externally added abrasive: strontium titanate 0.8%.
(5) lubricant: zinc stearate 0.06%.

[Cleaning condition]

(1) material: urethane rubber, hardness: 65°
(2) blade thickness: 1.5 mm
(3) linear pressure on the surface layer: 25 g/cm
(4) contact angle against the photosensitive member $\theta=24°$ The photosensitive member for electrophotography was one prepared by coating an Al cylinder of 60 mm-dia.×260 mm-length successively with an intermediate layer, a charge transport layer composed of 1 part of the bisazo pigment used in Example 1 and 1 part of polycarbonate A, and a charge generation layer in this order. The charge generation layer constituting the surface layer was composed of 1 part of the bisazo pigment used in Example 1 (charge-generating material) 11 parts of the hydrazone compound used in Example 1 (charge-transporting material) and 14 parts of polycarbonate resin (binder resin). The charge generation layer was formed in an initial thickness of 8 μm and showed a surface hardness of 30 g.

Figure 3:
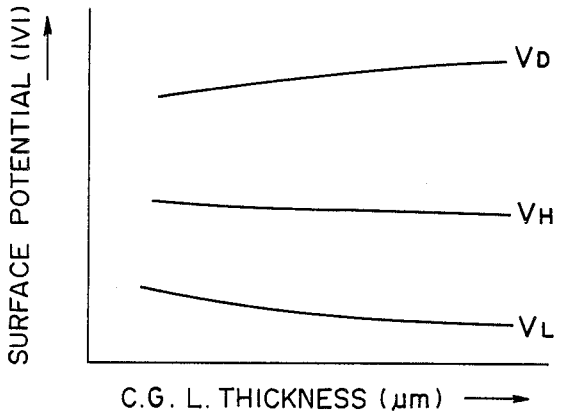
FIG. 3 is a graph showing the dependency of the surface potential of a photosensitive member comprising a laminated structure of intermediate layer/charge transport layer (C.T.L.)/charge generation layer (C.G.L., surface layer) on the thickness of the charge generation layer.

The photosensitive member was set to have a surface potential characteristic as shown in FIG. 3 dependent on the thickness of the charge generation layer and the medium tone potential showed a thickness dependency of 8 V/μm.

The electrophotographic apparatus was subjected to 5000 sheets of successive image formation test. The results are shown in the following Table 4.

TABLE 4

| Item | | Environment: Normal temp.-normal humidity | High temp.-high humidity |
|---|---|---|---|
| Image quality during 5000 sheets of copying | Image-flow | None | None |
| | Fading | None | None |
| | Abrasion scracthes on images | None | None |
| | Image density change | Very little | Very little |
| Medium tone potential charge* | | +30 | +25 |
| Reduction in thickness of photosensitive layer after 5000 sheets (μm) | | 4 | 3 |
| Abrasion per 1000 rotations (Å) | | 1140 | 860 |

*V (after 5000 sheets) − V (initial stage)

What is claimed is:

1. An electrophotographic apparatus comprising an electrophotographic photosensitive member and means for applying an electrophotographic cycle to the electrophotographic photosensitive member, wherein said means for applying an electrophotographic cycle includes abrasion means comprising a cleaning blade, wherein the photosensitive member is in the form of a cylinder having a diameter of 60 mm or less and comprises a laminated photosensitive surface layer including a charge generation layer and a charge transport layer, the charge generation layer having a thickness of 5 μm or less, and wherein the abrasion means causes an abrasion of the surface layer of the photosensitive member at a rate of 250 Å or more per 1000 electrophotographic cycles applied to the photosensitive member.

2. An apparatus according to claim 1, wherein said electrophotographic cycle includes charging, image exposure, toner development, toner transfer, remaining toner cleaning, and exposure for erasing remaining electric charge.

3. An apparatus according to claim 1, wherein the surface layer of the photosensitive member comprises at least a charge-transporting material and a binder resin.

4. An apparatus according to claim 1, wherein said photosensitive member comprises an organic photoconductor.

5. An apparatus according to claim 1, wherein the surface layer of the photosensitive member has a hardness of 60 g or less.

6. An apparatus according to claim 1, wherein said photosensitive member shows a change in latent image surface potential at either a dark part or a medium tone part per unit change in thickness of its surface photosensitive layer of 15 V/μm or less.

7. An apparatus according to claim 1, wherein said photosensitive member has a diameter of 30 mm or less.

8. An apparatus according to claim 1, wherein said abrasion means comprises a developer comprising the toner.

9. An apparatus according to claim 8, wherein said developer comprises a one component-type toner containing a magnetic material.

10. An apparatus according to claim 9, wherein said one component-type toner also comprises an externally added abrasive material.

11. An apparatus according to claim 1 wherein said cleaning blade comprises urethane rubber having a hardness of 60°–80°, exerts a linear pressure of 20 g/cm –40 g/cm against the photosensitive member and contacts the photosensitive member at an angle of 20°–30°.

12. An apparatus according to claim 1, wherein said electrophotographic cycle includes charging, image exposure, toner development, toner transfer and remaining toner cleaning.

* * * * *

UNITED STATES PATENT AND TRADEMARK OFFICE

CERTIFICATE OF CORRECTION

PATENT NO. : 4,931,841

DATED : June 5, 1990

INVENTOR(S) : TOSHIYUKI YOSHIHARA

It is certified that error appears in the above-identified patent and that said Letters Patent is hereby corrected as shown below:

TITLE PAGE:
IN [57] ABSTRACT

Line 11, "250 Åor" should read --250 Å or--.

COLUMN 5

Line 12, "frequency" should read --frequently--.

COLUMN 11

Line 9, "resultion" should read --resolution--.
TABLE 1, "Abration" should read --Abrasion--
(three occurrences).

COLUMN 12

Line 1, "affects" should read --affect--.
Line 43, "27 82 m" should read --27 μm--.
TABLE 2, "Abration" should read --Abrasion--
(three occurrences).

COLUMN 13

Line 61, "chage-generating" should read
--charge-generating--.

UNITED STATES PATENT AND TRADEMARK OFFICE

CERTIFICATE OF CORRECTION

PATENT NO. : 4,931,841

DATED : June 5, 1990

INVENTOR(S) : TOSHIYUKI YOSHIHARA

It is certified that error appears in the above-identified patent and that said Letters Patent is hereby corrected as shown below:

COLUMN 15

TABLE 3, "Abration" should read --Abrasion-- (three occurrences).
Line 62, "materia:" should read --material:--.

COLUMN 16

Line 18, "material:" should read --blade material:--.

Signed and Sealed this

Fourteenth Day of July, 1992

*Attest:*

*Attesting Officer*

DOUGLAS B. COMER

*Acting Commissioner of Patents and Trademarks*